United States Patent [19]

Chang

[11] Patent Number: 4,489,147

[45] Date of Patent: Dec. 18, 1984

[54] ORGANIC PHOTOCONDUCTIVE ELEMENTS EMPLOYING A POLYCARBONATE RESIN

[76] Inventor: Mike S. H. Chang, Danbury, Conn.

[21] Appl. No.: 331,402

[22] Filed: Dec. 16, 1981

[51] Int. Cl.[3] ..... G03G 5/06

[52] U.S. Cl. ..... 430/58; 430/59; 430/134

[58] Field of Search ..... 430/58, 59, 134

[56] References Cited

U.S. PATENT DOCUMENTS 4,273,846 6/1981 Pai et al. ..... 430/58

4,301,224 11/1981 Kozima et al. ..... 430/58

*Primary Examiner*—John E. Kittle

*Assistant Examiner*—John L. Goodrow

*Attorney, Agent, or Firm*—Melvin J. Scolnick; Albert W. Scribner; William D. Soltow, Jr.

[57] ABSTRACT

Organic photoconductive elements with a charge generating layer and a charge transport layer carried on an electroconductive support are disclosed. The invention involves the combined use of a polycarbonate resin having a weight average molecular weight ranging from about 25,000 to about 45,000 as an adhesive in the bonding layer on the electroconductive support and as a binder in the charge transporting layer forming a homogeneous phase to provide a receptive and retentive base layer for the charge-generating layer.

7 Claims, No Drawings

ORGANIC PHOTOCONDUCTIVE ELEMENTS EMPLOYING A POLYCARBONATE RESIN

BACKGROUND OF THE INVENTION

The present invention relates to the field of electrophotographic reproduction and, more particularly, to dual layer organic photoconductive elements such as belts, drums, webs, or the like, which are used in machines such as copying machines. Reference is made to U.S. Pat. Nos. 3,615,415, 3,824,099 and 4,150,987 for their discussion of the general field of the present invention and for their disclosure of some of the specific materials and procedures over which the present invention represents an improvement.

Aforementioned U.S. Pat. Nos. 3,824,099 and 4,150,987 relate to dual layer organic photoconductive elements comprising a conductive substrate such as a paper, metallized plastic film or metal plate, supporting two basic layers, namely a charge generating layer and a charge transport layer. Either layer may be adjacent the conductive substrate, and an adhesive bonding layer may be applied to bond the charge generating layer to the electroconductive support.

During use, the photoconductive element is charged, exposed to light passed through or reflected by the light-transmissive areas of an imaged original sheet to conduct away the charge in the exposed areas, and the charge retaining or unexposed areas are either "inked" with toner which is transferred to a copy sheet or are first transferred to a copy sheet and then "inked" with toner thereon. The toner is fused on the copy sheet to form fixed images corresponding to the images present on the original sheet.

Dual layer organic photoconductive elements were developed in order to provide extremely fast response to light exposure within the visible range of the spectrum. Preferred materials in this respect are Chlorodiane Blue as the charge generating organic chemical of the charge generating layer and p-type hydrazones or triaryl pyrazolines as the organic chemicals of the charge transport layer.

Chlorodiane Blue is a preferred charge generating material because it has good stability and provides photoconductive elements having a desired shelf life or duration of storage prior to breakdown and deterioration or loss of the charge generating properties. Chlorodiane Blue also has a superior light sensitivity and charge generating properties over a broad portion of the visible light range, i.e., between 400 mu and 700 mu.

Charge generating layers based upon Chlorodiane Blue dye or other known charge generating organic chemicals are thin layers which contain the dye in solid particulate form and which therefore are relatively brittle and have low cohesive and adhesive strength.

In order to provide a bond between the charge generating layer and the conductive support, e.g., commonly a metallized plastic film such as aluminized polyester available from the duPont Company under the trademark Mylar, it is known from Example 6F of U.S. Pat. No. 4,150,987 to apply a bonding layer of a polycarbonate resin to the conductive support. U.S. Pat. No. 4,150,987 also discloses that polymeric resins, such as polycarbonate resins, can be used as a binder for the charge transport layer, and the fact that other known constituents may be included in the charge transport layer for enhanced adhesion.

We have discovered that known organic photoconductive elements, such as the elements described in the example given above, are still susceptible to delamination and having the problem of brittleness, especially after long term storage, whereby the bond between the charge generating layer and the electroconductive support becomes relatively easy to break down and the charge generating layer and charge transport layer also become relatively easy to peel or flake from the support to render the electroconductive element less desirable for its intended purpose.

Solutions to these types of problems are described in commonly assigned and copending U.S. patent application Nos. 214,362, filed Dec. 8, 1980, for "Photosensitive Elements and Process" by Chang et al, and 296,667, filed Aug. 26, 1981 for "Photosensitive Elements and Process" by Chang et al.

SUMMARY OF THE INVENTION

The novel dual-layer photoconductive elements of the present invention were developed in order to provide photoconductive elements which have the known response advantages of dual-layer elements, particularly those based upon Chlorodiane Blue in the charge generating layer, and which are substantially strong and resistant to delamination and flaking or peeling or the photosensitive layers from a flexible electroconductive support such as a metallized plastic film.

The present invention is based upon the discovery that the combined use of at least one polycarbonate resin having a weight average molecular weight ranging from about 25,000 to about 45,000 as the adhesive layer used for bonding the charge generating and transport layers to the support and also the addition of the polycarbonate resin in the form of a homogeneous phase as the binder for the charge transport layer in an amount from about 35 to about 65 percent based upon the weight of the charge transport layer, provides an unexpectedly strong bond between particulate charge generating chemicals responsive to actinic radiation to generate an electron-hole pair, a flexible support such as a metallized plastic film and a resin-containing charge transfer supercoat.

The present invention is also based upon the discovery of the use and application of the photoreceptor described herein in a method for forming an electrophotographic image whereby one electrostatically charges in the dark the surface of an organic photoconductive element comprising an electroconductive plastic film support, a bonding layer of an adhesive material on said support, a charge generating layer comprising a particulate charge generating organic chemical adhered to said bonding layer, and a charge transport layer comprising a charge transport organic chemical and a binder material for the charge transport chemical adhered to said charge generated layer, characterized by said adhesive bonding layer and said binder material comprising at least one polycarbonate resin having a weight average molecular weight ranging from about 25,000 to about 45,000, said binder material forming a homogeneous phase within said charge transport layer and comprising from about 35 to 65 weight percent based upon the weight of the charge transport layer, followed by exposing the surface of the photoconductive element to actinic radiation and discharging the surface of the element in an image-wise fashion corresponding to the pattern of actinic radiation to produce a latent electrostatic image thereon.

DESCRIPTION OF THE PREFERRED EMBODIMENTS

In accordance with the present invention, I have found that by the combined application of at least one polycarbonate resin having a weight average molecular weight ranging from about 25,000 to about 45,000 and most preferably, a weight average molecular weight ranging from about 30,000 to about 40,000, in both the adhesive layer and the charge transport layer of an organic photoconductor having a charge generating layer and a charge transport layer on an electroconductive support, the photoreceptor thereby prepared has excellent adhesion bonding to the substrate, and the problems of delamination, brittleness and flaking are essentially eliminated.

There are several polycarbonate resins that are particularly suitable for use according to the present invention. Examples of these types of polycarbonate resins include poly(oxycarbonyloxy-1, 4-phenyleneisopropylidene-1, 4-phenylene), poly(oxycarbonyloxyhexamethylene), poly (oxycarbonyloxy-2-methyl-1, 4-phenylenecyclohexylidene-3-methyl-1, 4phenylene), poly(oxycarbonyloxy-2-methyl-1, 4-phenyleneisopropylidene-1, 4-phenylene), poly(oxycarbonyloxy-3-methyl-1, 4-phenylenebenzylidene-2methyl-1, 4-phenylene), poly(oxycarbonyloxy-1, 4-phenylene-2, 2-butylidene-1, 4-phenylene), poly(oxycarbonyloxy-1, 4-phenyleneisobutylidene-1, 4-phenylene), poly[oxycarbonyloxy-1, 4-phenylenedi(isopropylidene-1, 4-phenylene)], and poly[oxycarbonyloxy-1, 4-phenylene(methyl)phenylmethylene-1, 4-phenylene]. Some specific examples of the types of commercially available polycarbonate resins having a weight average molecular weight within the range varying from about 25,000 to about 45,000 that can be used in the practice of the present invention include polycarbonate resins such as Merlon M-39, M-40, M-50 and M-60 (all tradename products of the Mobay Chemical Company), and various Lexan polycarbonate resins (Lexan is a tradename of the General Electric Co.).

When one resin or a mixture of polycarbonate resins is used as the adhesive layer, it is preferred in accordance with the present invention that the polycarbonate resins be substantially all that is required for the adhesive layer and therefore it should not be necessary to include any other polymeric resins as a base for the adhesive layer. However, minor amounts of other ingredients such as resins, dyes or the like, can be present provided that such additives do not interfere with or diminish the photosensitive or charge generating properties of the active organic chemical, such as Chlorodiane Blue. Generally, it is preferred that the one or more polycarbonate resins added to the charge transport layer as the binder, be added in an amount varying from about 35 to about 65 weight percent based upon the weight of the charge transport layer. By employing one polycarbonate resin or a mixture of polycarbonate resins having a weight average molecular weight in the range of about 25,000 to about 45,000 (i) in the charge transport layer as a homogeneously formed binder in an amount varying from about 35 to about 65 percent by weight of the charge transport layer and (ii) in the adhesive layer, excellent adhesion of the photoconductor is obtained. As described above, minor amounts of other ingredients, e.g. resins, dyes or the like, can also be incorporated into the charge transport layer.

The improved photoreceptor in accordance with the present invention is particularly effective for the production of dual layer photoconductive elements having a metallized or otherwise conductive plastic film foundation or support. A preferred support in the field of dual-layer photoconductive elements is aluminized polyethylene terephthlate film available under the trademark Mylar. However, plastic films have poor receptivity or retentivity with respect to the conventional particulate or powdery coatings of organic charge generating chemicals such as Clorodiane Blue and squarylium dyes or mixtures thereof. While the application of the resinous supercoating containing the organic charge transfer chemical over the charge generating layer improves the bond between the latter and the film foundation, and the application of an undercoating or bonding layer, such as a single linear polyester, provides a further improvement in the bond to the film foundation, nevertheless the resultant bond is unsatisfactory since delamination, flaking and/or peeling of the coating(s) from the film can result from handling or repeated use of the photoconductive element, particularly after a long term storage of the photoreceptor.

Reference is again made to U.S. Pat. No. 4,150,987 which discloses the use of an adhesive undercoating or bonding layer of a polycarbonate resin between a conductive film support and a charge generating layer of an organic chemical such as Chlorodiane Blue. Reference is also made to this patent and to U.S. Pat. No. 3,824,099 for their disclosure of some suitable charge transport organic chemicals such as p-type hydrazones and triaryl pyrazolines and charge transport layers containing such chemicals and the organic binders used therewith.

The following Example is given as an illustration of a preferred embodiment of the present invention and should not be considered limitative.

EXAMPLE

The general procedure described in Example 1 of U.S. Pat. No. 4,150,987 was followed to produce a three-layered organic photoconductive element according to the invention of said Patent. Said element was used as a control for comparison purposes to demonstrate the improved results made possible by the present invention. The general procedure of the Example was repeated except in accordance with the present invention the adhesive layer resin and the binder resin used in the charge transport layer was the polycarbonate resin Merlon M-50 (Mobay Chemical Co.) having a weight average molecular weight of about 35,000 to 38,000. Solvents used for the M-50 resin included methyl chloride and 1, 1, 2 trichloroethylene. This resin was added as the adhesive layer, and was also added as the binder to the charge transporting layer (approximately 60 percent by weight of the charge transport layer).

Each layer of coating after being meniscus coated was dried by being exposed to infrared radiation and then placed in a forced air oven at 250° F. The exposure period (minutes) for each layer is summarized below:

| Layer | IR (Min.) | Oven (Min.) |
|---|---|---|
| Adhesive Layer | 4 | 2 |
| Charge Generating Layer | 4 | 3 |
| Charge Transport Layer | 4 | 2-3 |

Generally, the coating weight of the adhesive layer was about 13–15 mg/ft$^2$; charge generating layer (Chlorodiane Blue) about 16–20 mg/ft$^2$; and the charge transport layer (hydrazone) about 1.6–2.1 gm/ft$^2$.

Photoconductive elements prepared in accordance with Example I of U.S. Pat. No. 4,150,987 (control sample) and elements prepared in accordance with the present invention, were tested by subjecting both types of elements to use in an electrophotographic process six months after the coating processes. Although both photoconductive elements exhibited substantially identical photoresponse properties, the adhesion properties of the control sample was rated as a "Failure" while that of the samples prepared in accordance with the present invention was rated "Pass" based on subjecting these samples to a critical adhesion test as described below:

Critical Adhesion Test—The organic layered photoconductor is folded 180° with the photoconductor coating facing inward. A force is applied along the folding edge just sufficient in magnitude to creep the Mylar substrate. If the coating becomes delaminated or falls apart due to this action, the adhesion of the coating is rated as a "Failure"; if it is intact, i.e., essentially no delamination or falling apart, it is rated as a "Pass". It was noted that photoconductive elements prepared in accordance with the present invention and subject to this test not only passed, but appeared to be in excellent condition.

Variations and modifications of the present invention will be apparent to those skilled in the art in the light of the present disclosure and within the scope of the present claims.

I claim:

1. An organic photoconductive element comprising an electroconductive plastic film support, a bonding layer of an adhesive material on said support, a charge generating layer comprising a particulate charge generating organic chemical adhered to said bonding layer, and a charge transport layer comprising a charge transport organic chemical and a binder material for the charge transport chemical adhered to said charge generating layer, characterized by said adhesive bonding layer and said binder material comprising at least one polycarbonate resin having a weight average molecular weight ranging from about 25,000 to about 45,000, said binder material forming a homogeneous phase within said charge transport layer and comprising from about 35 to about 65 weight percent based upon the weight of the charge transport layer.

2. An organic photoconductive element according to claim 1 wherein said polycarbonate resins are selected from the group consisting of poly(oxycarbonyloxy-1, 4-phenyleneisopropylidene-1, 4-phenylene), poly(oxycarbonyloxyhexamethylene), poly(oxycarbonyloxy-2-methyl-1, 4-phenylenecyclohexylidene-3-methyl-1, 4-phenylene), poly (oxycarbonyloxy-2-methyl-1, 4-phenyleneisopropylidene-1, 4-phenylene), poly(oxycarbonyloxy-3-methyl-1, 4-phenylenebenzylidene-2-methyl-1, 4-phenylene), poly(oxycarbonyloxy-1, 4-phenylene-2, 2-butylidene-1, 4-phenylene), poly(oxycarbonyloxy-1, 4-phenyleneisobutylidene-1, 4-phenylene), poly [oxycarbonyloxy-1, 4-phenylenedi(isopropylidene-1, 4-phenylene)], and poly[oxycarbonyloxy-1, 4-phenylene (methyl)phenylmethylene-1, 4-phenylene].

3. An organic photoconductive element according to claims 1 or 2 wherein the weight average molecular weight of said polycarbonate resins varies from about 30,000 to about 40,000.

4. An organic photoconductor element according to claim 1 wherein said charge generating organic chemical comprises Chlorodiane Blue.

5. A method for forming an electrophotographic image comprising:

(a) electrostatically charging in the dark the surface of an organic photoconductive element comprising an electroconductive plastic film support, a bonding layer of an adhesive material on said support, a charge generating layer comprising a particulate charge generating organic chemical adhered to said bonding layer, and a charge transport layer comprising a charge transport organic chemical and a binder material for the charge transport chemical adhered to said charge generating layer, characterized by said adhesive bonding layer and said binder material comprising at least one polycarbonate resin having a weight average molecular weight ranging from about 25,000 to about 45,000, said binder material forming a homogeneous phase within said charge transport layer and comprising from about 35 to about 65 weight percent based upon the weight of the charge transport layer;

(b) exposing said surface of the photoconductive element to actinic radiation; and (c) discharging said surface of the photoconductive element in an image-wise fashion corresponding to the pattern of actinic radiation to produce a latent electrostatic image thereon.

6. A method according to claim 5 wherein said polycarbonate resins are selected from the group consisting of poly(oxycarbonyloxy-1, 4l-phenyleneisopropylidene-1, 4-phenylene), poly(oxycarbonyloxyhexamethylene), poly (oxycarbonyloxy-2-methyl-1, 4-phenylenecyclohexylidene-3-methyl-1, 4-phenylene), poly(oxycarbonyloxy-2-methyl-1, 4-phenyleneisopropylidene-1, 4-phenylene), poly(oxycarbonyloxy-3-methyl-1, 4-phenylenebenzylidene-2-methyl-1, 4-phenylene), poly(oxycarbonyloxy-1, 4-phenylene-2, 2-butylidene-1, 4-phenylene), poly(oxycarbonyloxy-1, 4-phenyleneisobutylidene-1, 4-phenylene), poly[oxycarbonyloxy-1, 4-phenylenedi(isopropylidene-1, 4-phenylene)], and poly[oxycarbonyloxy-1, 4-phenylene(methyl)phenylmethylene-1, 4-phenylene].

7. A method according to claims 5 or 6 wherein the weight average molecular weight of said polycarbonate resins varies from about 30,000 to about 40,000.

* * * * *